US005129298A

United States Patent [19]

Cresson et al.

[11] Patent Number: 5,129,298

[45] Date of Patent: Jul. 14, 1992

[54] AUTOMATIC MACHINE FOR SLICING NON-RIGID PRODUCTS, SUCH AS FOODSTUFFS SUCH AS MEATS

[75] Inventors: Christian Cresson, Aville; Pascal Boucher, Angers; Jean Saget, Aville, all of France

[73] Assignee: Societe des Viandes Bretagne Anjou-Soviba la Noelle Ancenis (Loire Atlantique) France, France

[21] Appl. No.: 735,544

[22] Filed: Jun. 28, 1991

[30] Foreign Application Priority Data

Jun. 29, 1990 [FR] France ..... 90 08281

[51] Int. Cl.[5] ..... B26D 7/27

[52] U.S. Cl. ..... 83/72; 83/365; 83/367; 83/437; 83/477; 83/719; 83/435.1

[58] Field of Search ..... 83/72, 360, 364, 365, 83/367, 703, 708, 719, 412, 419, 435.1, 437, 473, 477

[56] References Cited

U.S. PATENT DOCUMENTS 3,894,457 7/1975 Miller et al. ..... 83/27

4,379,416 4/1983 Kuchler ..... 83/72

*Primary Examiner*—Hien H. Phan

*Attorney, Agent, or Firm*—Seidel, Gonda, Lavorgna & Monaco

[57] ABSTRACT

An automatic machine is provided for slicing non-rigid products, such as foodstuffs or meats. The machine includes a carriage with a plate supporting the product to be sliced. This carriage is mobile in relation to the cutting assembly which permits the product to be sliced. The machine further including a device for removing the cut slices. A control circuit is provided for receiving information from a detector. An input terminal controls the angle between the plate of the carriage thereby making the angle between the plate and the carriage adjustable.

11 Claims, 3 Drawing Sheets

AUTOMATIC MACHINE FOR SLICING NON-RIGID PRODUCTS, SUCH AS FOODSTUFFS SUCH AS MEATS

The present invention relates to an automatic machine for slicing non-rigid products such as foodstuffs and in particular meats, which machine comprises:

a cutting assembly with motor and blade;

a carriage with a plate supporting the product to be sliced, this carriage being mobile in relation to the cutting assembly to cut the product into slices;

a means of removing the cut slices.

A slicing means of this type is known in particular in the foodstuffs industry or in its applications for domestic purposes for cutting products such as pieces of ham, sausages, etc. This automatic or non-automatic slicing machine, i.e. of which the operating cycle may be automatic or not automatic, enables slices of the products listed hereinabove to be cut without, however, a unitary weight for each slice having to be adhered to.

The object of these machines is to cut slices of regular thickness, often relatively fine, and without concern for the weight of each slice in relation to the others. In effect, the products thus sliced are sold by weight and not by the slice.

A slicing machine of this type also enables less rigid products, such as ham, sausage or bacon to be cut, but does not enable slices of a uniform weight (for example 50 grammes or 100 grammes) to be obtained. In effect, it is certianly possible to adjust the thickness of the slice to be cut but there is no way of obtaining a slice of a set weight with any accuracy; this can only be evaluated by approximation. However, this approximation is not sufficient to give a constant result when a piece of muscle is cut into slices, especially if this piece is not prismatic or cylindrical in shape and the variation in weight of the slices cut may be great for a constant slice thickness.

Even more important is that this machine does not enable an automatic slicing of a piece of muscle in order to obtain slices of the same weight.

It is necessary, in many fields, to cut slices of a constant weight or even, in a more general manner, of a set weight. This need exists in particular in the foodstuffs industry, in community restaurants or in related fields.

Thus the present invention has as its aim the production of a slicing machine enabling a piece of relatively flexible material such as a muscle to be cut into slices with a predetermined weight, which are the same or differ from one slice to the other, automatically according to a predetermined programming and without there being any need for adjustment when changing to a different product of the same type.

To this end, the invention relates to an automatic slicing machine of the above type characterised in that it comprises:

a recognition and stop plate;

a means for detecting the contact surface of the product to be sliced against the recognition plate;

a thrust means pushing the product against the plate;

the angle between the plate and the carriage plate is adjustable;

a means for adjusting the angle of the recognition plate and of the carriage plate to alter the contact surface of the product against the recognition plate;

a means for adjusting the position of the plate in relation to the blade to adjust the thickness of the slice to be cut;

a control circuit, receiving information from the detecting means and the input terminal, for controlling the relative inclination, the position of the plate, the reciprocating movement of the carriage according to the number of cuts to be made and the movement of the means for removing the cut slices.

Due both to the adjustable angle between the stop plate and the plate supporting the piece of product to be sliced on the carriage, and to the fact that this product to be sliced is flexible and relatively deformable, it is possible to alter the contact surface by altering the angle. Since the surface detection means determines the contact surface, and knowing the density of the product to be sliced, it is easy, taking as a hypothesis that is as close as possible to reality that the shape of the slice is cylindrical in the mathematical sense,, to determine the volume and consequently the thickness since this thickness is the height of the cylinder (volume divided by surface area). The slicing instructions, i.e. the number of slices to be produced, with the weights thereof, may be entered through the input terminal, for example a keyboard. It is also possible to control the collection or separation of the slices into stacks with varying numbers of slices, etc, by means of this keyboard.

According to a further feature, the detecting means is a video system comprising a video camera, a means of illuminating the product at the edge thereof that is adjacent to the recognition and stop plate, and an image analyser.

Depending on the product, the system may work by light reflection or transmission. In the case of the latter, the recognition and stop plate is transparent or translucent and the camera of the detection means is placed against the surface of the plate, opposite the surface against which the product rests, the lighting means being located behind the product to illuminate, against the light, the edge of the contact surface of the product on the recognition and stop plate.

Depending on the products, the carriage plate is horizontal or inclined, by lifting about a articulation, in such a way that the product is pressed, by gravity, against the recognition and stop plate which is, in this case, inclined towards the rear.

In general, the dihedral angle formed by the carriage plates and the detecting means is of the order of 90°.

According to a further feature, the recognition and stop plate is mounted on a support which is adjustable in inclination and in translation in relation to the carriage and to the blade.

According to a further feature, the cutting assembly is a rotatary blade with a motor.

According to a further feature, the machine comprises means for cleaning the surface of the recognition and stop plate against which the product to be cut rests.

According to a further feature, the means of adjusting the inclination of the carriage plate, the recognition and stop plate, the translation means for the support carrying the recognition and stop plate and the blade are jacks.

The present invention will be described in a more detailed manner with the aid of the attached drawing in which.

Figure 1A:
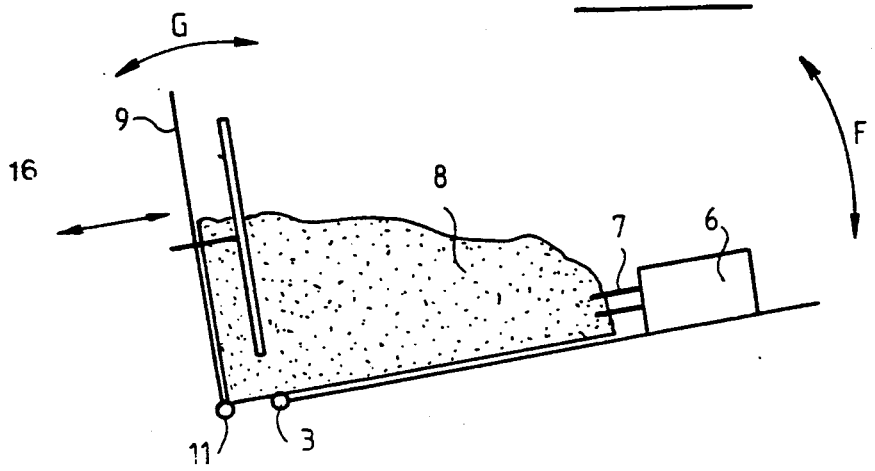
FIG. 1A is a simplified view of the adjusting kinetics of the machine in FIG. 1.
Figure 1:
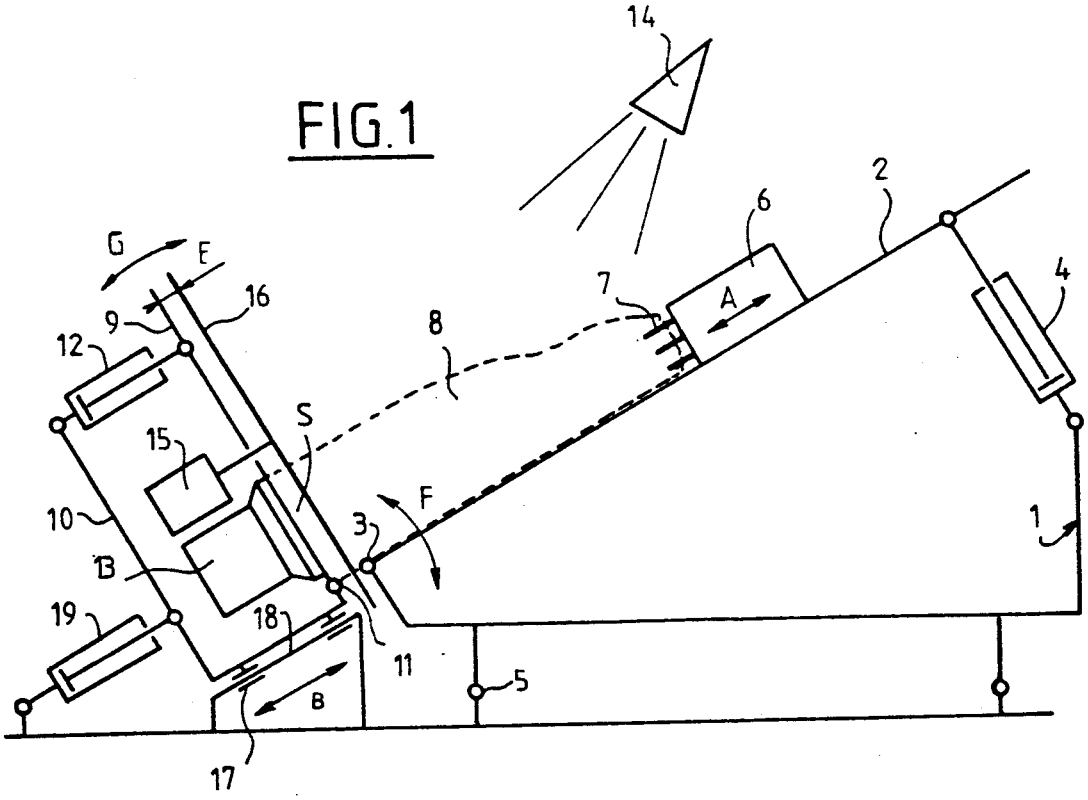
FIG. 1 is a side view of the automatic slicing machine according to the invention.
Figure 2:
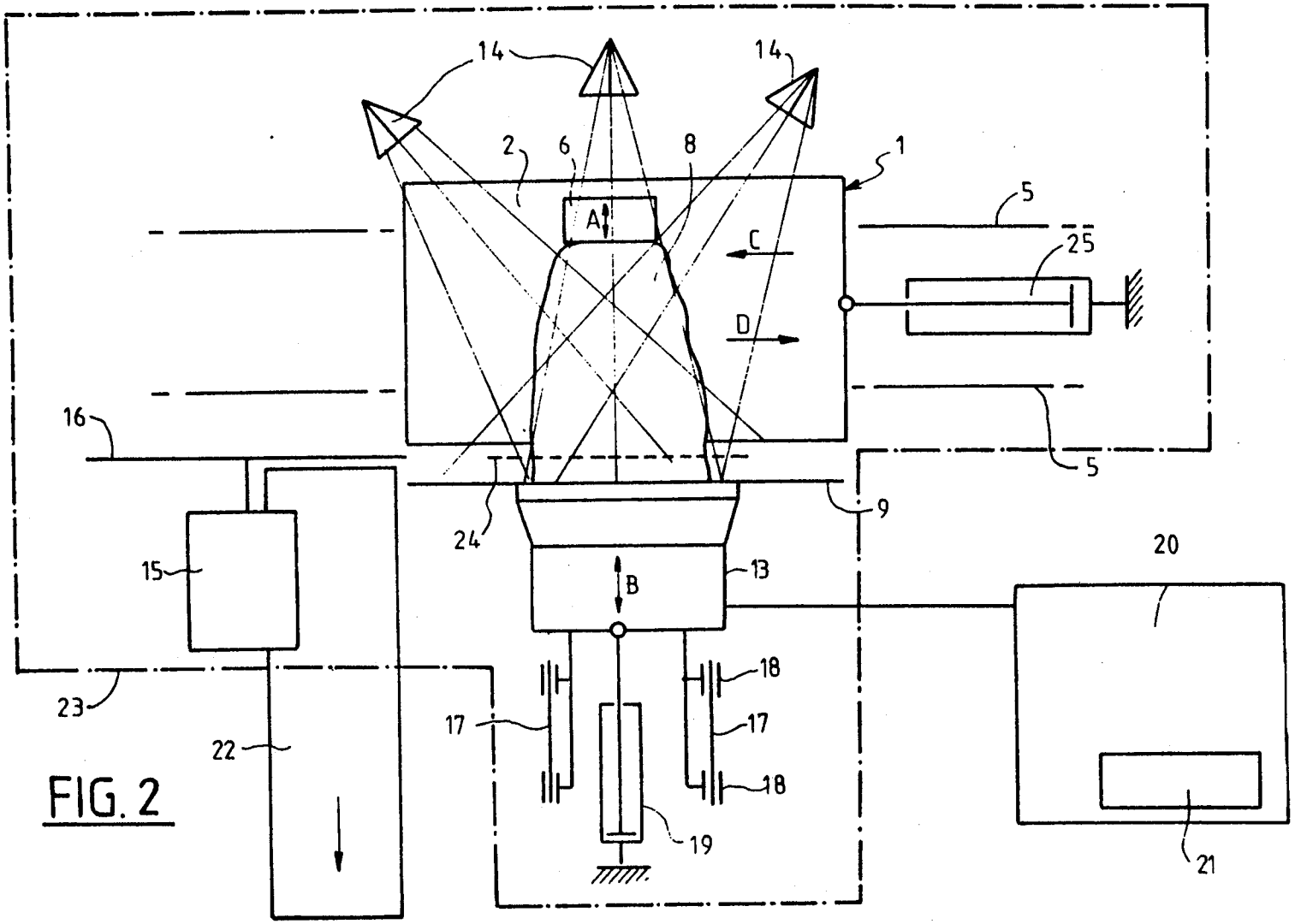
FIG. 2 is a plan view of the machine in FIG. 1.

According to FIGS. 1, 1A and 2 the automatic machine for slicing non-rigid products such as muscles is comprised of a carriage 1 provided with a plate 2 connected to the carriage by a horizontal articulation 3; the inclination of the plate 2 is controlled by an adjusting means 4 consisting of a jack. The carriage is displaced along rails 5 in a direction perpendicular to the plane of FIG. 1 under the action of a jack 25. The plate 2 also comprises a pressing member 6 provided with retractable claws 7; this pressing and catching element is moveable in the direction of the double arrow A. The plate supports a product 8 shown by a broken line. Under the effect of the inclination, and, if necessary, with pressure from the member 6, the product 8 is pressed against a recognition plate forming a stop 9.

The recognition plate 9 is connected to a support 10, shown schematically by a line, by an articulation 11 and by a means 12 for adjusting the inclination. The stop plate is inclined towards "the rear", i.e. towards the left hand side of the drawing in relation to the vertical direction. Behind this recognition plate forming a stop 9 which, in this embodiment, is transparent, there is a detecting means, comprised of a video camera 13, with which there is associated an image analyser, which is not shown, as well as illuminating means 14 situated on the other side of the plate 9, behind the product 8 so as to illuminate the product against the light to accentuate the contrast between the bearing surface S of the product against the plate 9 and the part of this plate that is not covered by the product. The image analyser can then measure exactly the contact surface area S and, knowing the density of the product 8, determine the volume thereof from the weight predetermined for the slice. From this volume and the surface area S, the system defines the thickness E of the slice to be cut.

The machine also comprises a cutting sub-assembly comprised of a motor 15 and a rotary blade 16.

The blade 16 and the motor 15 are secured in the space and the plate 9 may be displaced in translation and inclination with regard to the blade 16.

The blade 16 is parallel to the recognition and stop plate 9 and the distance between the blade and plate corresponds to the thickness E of the slices to be cut.

The inclination of the plate 9 is adjusted by means of the jack 12 pivoting about the articulation 11.

The support 10 is mounted in a sliding manner on a guide 17 and sliding elements 18; the translation position, in the direction of the double arrow B, is defined by the jack 19.

In other words, the jack 19 controls the translation of the plate 9 (using means 17, 18) and the jack 12 controls the inclination of the plate 9 by providing about a shaft 11.

The drawing in FIG. 1 shows, very schematically, that the plate 9 is adjustably mounted; the adjustment of the blade 16 of the fixed cutting sub-assembly is adjusted automatically by the movement adjusting the plate 9.

It should be noted that the plate 9 must be transparent at the surface detector 13, the other parts thereof not having to be transparent. The recognition plate 9 is made of transparent material, preferably of a ground glass, and, in a manner not shown, the plate 9 is provided with a cleansing means, at least at the transparent surface, to make the detection of the edge of the surface area S as precise as possible.

FIG. 1A shows, in a manner more schematic than that of FIG. 1, the various movements for adjusting the contact surface of the product 8 of the recognition plate 9, firstly about the shaft 3 (rotation in the direction of the double arrow F for the plate 2 of the carriage 1), about the shaft 11 (roatation of the pate 9) in the direction of the double arrow G and translation of the plate 9, still in relation to the blade 16 for adjusting the thickness E.

The automatic machine also comprises, as FIG. 2 shows, a control circuit 20 provided with control console 21 such as a keyboard. The control circuit 20, connected to the detecting means 13, receives information from this detecting means to control the means of regulating the inclination and the thickness 4, 12, 19 as a function of the data introduced into the circuit; the data introduced into the circuit are: the density of the product to be sliced, the surface of the product to be sliced, the weight of the slices to be cut, the thickness of the slices, and the number of slices of each weight. Further data may relate to the removing means such as the conveyor belt 22 placed behind the blade 16 and onto which the cut slices fall. This conveyer may bring about the stacking up of a plurality of slices if it is at a standstill during the cutting of the slices; it can also separate the slices from each other by removing each slice after it is cut.

In this Figure, the cutting line is shown by dots 24, on the right, through the product 8. However, for slicing, the carriage 1 with the product 8 is displaced to the left against the blade 16.

Depending on the products to be sliced, in particular in the case of perishable products, such as meat, the the entire machine is placed in a refrigerated room which simultaneously ensures the ventillation of the motor 15 and the means 13. It may also be surrounded by a refrigerated room 23, the other parts of the environment thus having a slightly reduced temperature.

Protecting means, which are not shown, are provided both on the carriage or other mobile parts and close to the cutter sub-assembly.

Figure 3:
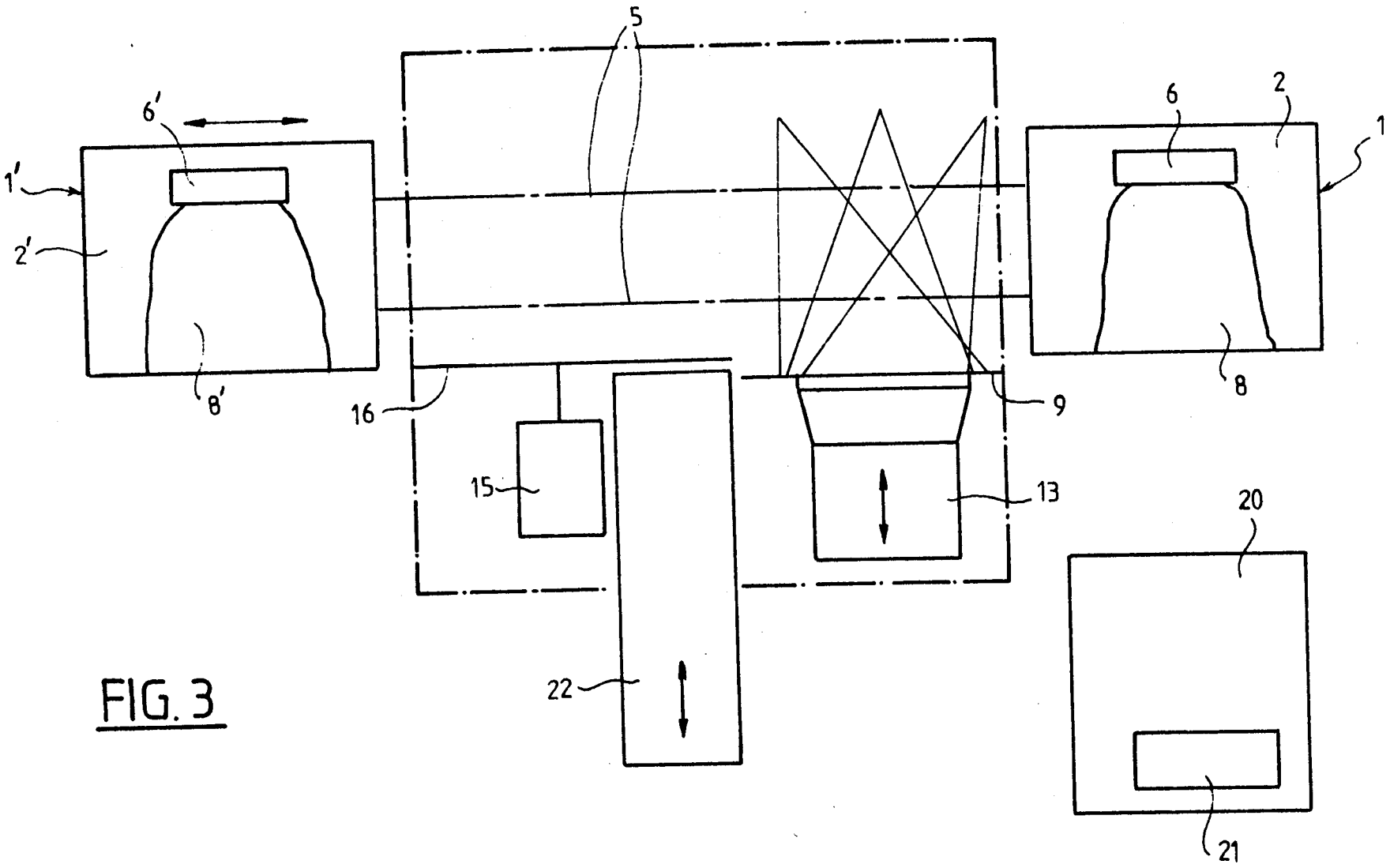
FIG. 3 shows a variant of the machine with two carriages.

In the case of foodstuffs, cleaning nozzles are provided on the machine inside the enclsoure to ensure that this is cleaned as many times as is necessary. FIG. 3 shows a variant of the machine which is described hereinabove using the same references as in FIGS. 1 and 2 for identical or similar elements. According to this variant, the carriage 1 is augmented by a carriage 1', identical thereto, in such a way as to permit loading of the plates 2 or 2' of the carriage 1 or 1' in dead time. In effect, while the product 8 on the carriage 1 is sliced. Product 8' is loaded onto carriage 1'. This carriage 1' then positions itself in the detection and cutting zone and the carriage 1 is expelled from this zone so that it may receive its new load.

As regards detecting and slicing, the slicing machine functions as follows:

Information relating to weight, and to the surface or thickness of the slices to be cut and their number having been introduced via the keyboard 21, the carriage 2 (or 2') is passed into the cutting zone to bring the product 8 (or 8') into abutment against the recognition plate 9 fixed in position (in relation to the carriage). The detecting means 13 then detects the contact surface of the product 8 against the plate 9. If this surface is sufficient and, most importantly, if it is compatible with the range of thickness authorised for the slice to be cut (lower limit, upper limit), the carriage 2 continues its displacemet in the direction of arrow C by sliding along the plate 9 to guide the product 8 against the blade 16 which slices by rotation. The cut slice falls onto the conveyer belt 22. When the cut is completed, the carriage 2 returns in the opposite direction (arrow D) and again places the product 8 against the recognition plate 9. The detecting means 13 carries out another detecting process, then the cut is made and the cycle continues.

In the case of the contact surface of the product 8 and the recognition plate 9 being very small, the control circuit 20 modifies the incline of the plate 2 in relation to the recognition plate to increase the contact surface of the product 8 with the plate. This analysis is continuous. When the surface is sufficient, the cutting process is continued.

In the opposite case, where the initial contact surface of the product 8 and the stop plate 9 is too large, this situation, which necessitates an intervention on the part of the machine operator, is displayed by the control circuit 20.

If the incline obtained by the plate 2 is not sufficient, it is possible to modify this incline further by acting on the plate 9 via its adjusting jack 12, the plate 9 then pivoting about the shaft 11. Finally, it is possible for the thickness E of the slice to be acted upon with the aid of the adjusting jack 19 which modifies the distance separating the recognition plate 9 and the blade 16.

In the case of automatic slicing of meat, it is advantageous to be able to select a variety of thickness for the slices, for example from 5 to 20 mm and from 20 to 50 mm.

Finally, it should be indicated that various modifications and variants are possible within the scope of the invention, in particular the jacks or activators may be mechanical, hydraulic, pneumatic or electric.

We claim:

1. An automatic machine for slicing nonrigid products such as foodstuffs and in particular meats comprising:

a cutting assembly with motor and blade;

a carriage with a plate supporting the product to be sliced, said carriage being mobile in relation to the cutting assembly to cut slices of product;

a means for removing cut slices, said removing means comprising a recognition and stop plate;

means for detecting the contact surface of the product to be cut against the recognition plate;

pressing means for pushing the product against the plate, the angle between the recognition plate and the plate of the carriage being adjustable;

means for adjusting the angle of the recognition plate and the plate of the carriage to alter the contact surface of the product against the recognition plate;

means for adjusting the position of the recognition plate in relation to the blade to adjust the thickness of the slice to be cut; and a control circuit which receives information from the detecting means and the input terminal to control the relative inclination, the position of the plate, and the reciprocating movement of the carriage according to the number of cuts to be made and the movement of the removing means for the cut slices.

2. An automatic slicing machine according to claim 1, wherein the detecting means is a video system comprising a video camera, means for illuminating the product at its edge close to the recognition plate, and an image analyzer.

3. An automatic slicing machine according to claim 2, wherein the recognition plate is transparent or translucent and the camera of the detecting means is placed against the surface of the recognition plate, opposite the side on which the product rests, and the illuminating means positioned behind the product to ensure taht the edge of the contact surface of the product on the recognition plate is against the light.

4. An automatic slicing machine according to claim 1, wherein the plate of the carriage can be lifted about an articulation.

5. An automatic slicing machine according to claim 1, wherein the recognition plate is inclined towards the rear.

6. An automatic slicing machine according to claim 1, wherein the recognition plate is mounted on a support which is adjustable in inclination and in translation in relation to the carriage and the blade.

7. An automatic slicing machine according to claim 1, wherein the cutting assembly is a rotating blade with a motor.

8. An automatic slicing machine according to claim 1, further comprising means for cleaning the surface of the recognition plate against which the product to be sliced rests.

9. An automatic slicing machine according to claim 1, wherein the means of adjusting the inclination of the plate of the carriage of the recognition plate and the means for translation of the support which carries the recognition plate is a jack.

10. An automatic slicing machine according to claim 1, wherein the carriage provided with a plate carrying the product is mobile in translation in front of the recognition plate and the blade in a direction that is parallel to the recognition plate and the blade.

11. An automatic slicing machine according to claim 1, further comprising a second carriage which is alternately placed in the cutting position with the first mentioned carriage, the loading of one of the carriages being carried out while the products supported by the other carriage are conversely being cut.

* * * * *